US008726967B2

(12) United States Patent
Llagostera Forns

(10) Patent No.: US 8,726,967 B2
(45) Date of Patent: May 20, 2014

(54) PIVOTING SUPPORT ASSEMBLY WITH LOCKING DEVICE FOR AN AWNING ARM

(75) Inventor: Joan Llagostera Forns, Alcover Tarragona (ES)

(73) Assignee: Llaza, S.A. (ES)

( * ) Notice: Subject to any disclaimer, the term of this patent is extended or adjusted under 35 U.S.C. 154(b) by 0 days.

(21) Appl. No.: 13/280,673

(22) Filed: Oct. 25, 2011

(65) Prior Publication Data

US 2012/0273144 A1 Nov. 1, 2012

(30) Foreign Application Priority Data

Oct. 26, 2010 (EP) ..... 10380135

(51) Int. Cl.
*E04F 10/00* (2006.01)

(52) U.S. Cl.
USPC ..... 160/45; 160/66; 160/70; 160/79

(58) Field of Classification Search
USPC ..... 160/66, 67, 70, 73, 45, 59
See application file for complete search history.

(56) References Cited

U.S. PATENT DOCUMENTS 6,619,363 B2 * 9/2003 Kroner et al. ..... 160/70
6,732,018 B2 * 5/2004 Osinga ..... 700/275
6,874,558 B2 * 4/2005 Mester et al. ..... 160/22
6,904,826 B2 * 6/2005 Hesener ..... 74/483 R
8,205,656 B2 * 6/2012 Ma ..... 160/22
2001/0027846 A1 * 10/2001 Osinga ..... 160/70
2003/0108259 A1 * 6/2003 Hesener ..... 384/247
2010/0032106 A1 * 2/2010 Ma ..... 160/22
2012/0273144 A1 * 11/2012 Llagostera Forns ..... 160/368.1

FOREIGN PATENT DOCUMENTS

EP 0186742 A2 7/1986
WO 2004/029381 A1 4/2004

* cited by examiner

*Primary Examiner* — Blair M. Johnson
(74) *Attorney, Agent, or Firm* — Barnes & Thornburg LLP

(57) ABSTRACT

A pivoting support assembly with a locking device for an awning arm—the support assembly includes a fixed support (10), a pivoting body (20) articulately supported on the fixed support (10) to pivot between a retracted position and a service position, an arm (30) articulately supported on the pivoting body (20) to rotate between a folded position and an extended position, and an adjustable stop (40) for limiting the movement of the pivoting body (20), thus determining the degree of inclination of the awning in the service position. The adjustable stop (40) has a circumferential groove (43) and a grip element (44). A locking member (50), which is moved by the arm (30) to a locking position, is inserted into the circumferential groove (43) such that the grip element (44) is accessible and the adjustable stop (40) can be rotated but cannot be axially moved with respect to the pivoting body (20).

11 Claims, 6 Drawing Sheets

PIVOTING SUPPORT ASSEMBLY WITH LOCKING DEVICE FOR AN AWNING ARM

TECHNICAL FIELD

The present invention relates to a pivoting support assembly with a locking device for an awning arm, applicable to awning devices in which the support assembly comprises pivoting bodies supporting the awning arms, adjustment means for adjusting the inclination of the pivoting bodies and of the awning in a service position, and a locking device for preventing the pivoting bodies from moving towards a retracted position when the arms are in an extended position.

BACKGROUND OF THE INVENTION

Awning devices comprising a box arranged in a fixed position in a support structure, such as a wall or the like, are known. Inside the box there is a winding roller which is rotated to extend or draw in a canvas of the awning. The front edge of the canvas is fixed to a load bar connected to distal ends of articulated arms having their proximal ends linked to said support structure by respective support assemblies. The articulated arms are elastically loaded to push the canvas towards an extended position.

Each support assembly comprises a support rigidly fixed to the support structure, a pivoting body articulately supported on said fixed support such that it can pivot about a pivot axis parallel to the axis of the winding roller between a retracted position, in which the load bar closes a front opening of the box with the canvas drawn in inside it, and a service position, in which the inclination of the pivoting body determines the degree of inclination of the awning with the canvas extended.

To limit the pivoting movement of the pivoting body, which determines the degree of inclination of the awning in the service position, the support assembly comprises adjustable stops the position of which can be adjusted by means of a driving tool. Each arm is articulately supported on the corresponding pivoting body such that it can rotate between a folded position and an extended position. When the winding roller is rotated in a winding direction overcoming the tension of the articulated arms, the canvas is drawn in and the pivoting bodies pivot towards their retracted positions to allow the load bar to close the box.

When the winding roller is rotated in an unwinding direction, the tension of the articulated arms extends the canvas and the pivoting bodies pivot by gravity towards their service position. To prevent wind or other factors from moving the pivoting bodies towards their retracted position while the arms and the canvas are in their extended position, the support assembly includes locking means linked to the movement of the arms for locking the pivoting bodies in their service position when the arms, and therefore the canvas, are in their extended position.

Patent DE-A-2853286 discloses an awning device of the type described above where the mentioned locking means comprise a locking member movable between an inactive position, in which said locking member does not interfere with said adjustable stop, and a locking position in which the locking member locks the adjustable stop with respect to the pivoting body when the pivoting body is in its service position, and a connecting rod connected to the locking member and to the arm such that when the arm is moved to its extended position said connecting rod moves the locking member towards its locking position, and when the arm is moved to its folded position the connecting rod moves the locking member back towards its inactive position.

A drawback of the locking means of the mentioned patent DE-A-2853286 is that the locking member is arranged on one side of the adjustable stop opposite the arm, and the connecting rod is arranged establishing a bridge above the locking member, which requires a complex construction and needs a large space. Furthermore, the locking member is fork-shaped, so it is bulky and requires a long guiding channel on the side of the adjustable stop opposite the arm. Another drawback is that the locking member hinders or prevents the access to the stop member when it is in the locking position, such that the degree of inclination of the awning cannot be adjusted when the awning is unfolded in the service position.

DESCRIPTION OF THE INVENTION

The present invention contributes to mitigating the previous and other drawbacks by providing a pivoting support assembly with a locking device for an awning arm which comprises a fixed support, a pivoting body articulately supported on said fixed support such that it can perform a pivoting movement about a pivot axis parallel to the axis of a winding roller of the canvas of the awning between a retracted position and a service position, and an arm articulately supported on said pivoting body such that it can rotate between a folded position and an extended position.

The support assembly further includes an adjustable stop for limiting said pivoting movement of the pivoting body, thus determining the degree of inclination of the awning in said service position, and locking means linked to the movement of the arm for locking the pivoting body in its service position when the arm is in its extended position, said locking means comprising a locking member movable between an inactive position, in which said locking member does not interfere with said adjustable stop, and a locking position, in which the locking member locks the adjustable stop with respect to the pivoting body when the latter is in its service position.

The adjustable stop has a circumferential groove and a grip element configured to be gripped by a rotating driving tool to adjust the position thereof. The relative position of said circumferential groove and said grip element is such that when the locking member is in its locking position, the locking member is inserted into the circumferential groove of the adjustable stop without interfering with the grip element or preventing the access of said driving tool to the grip element. The locking member inserted into the circumferential groove prevents the adjustable stop from moving in an axial direction with respect to a longitudinal axis thereof, but allows the adjustable stop to be able to be rotated about said longitudinal axis by means of the driving tool.

Thus, by means of the pivoting support assembly according to the present invention, the degree of inclination of the awning can be adjusted by acting on the adjustable stop by means of a driving tool even when the awning is completely unfolded, i.e., when the pivoting body is locked in its service position by the locking member and the arm is in the extended position.

In one embodiment, the adjustable stop comprises a rod and a stop head rigidly attached to said rod. The circumferential groove and the grip element are formed in the stop head. The rod has an outer thread coupled to the inner thread of a transverse hole formed in a stationary pin installed such that it can rotate about its own axis inside a housing formed in the fixed support. This stationary pin is parallel to said pivot axis with respect to which the pivoting support pivots. A rotation of the stop head of the adjustable stop varies the distance between the stop head and the stationary pin.

In another embodiment, the adjustable stop comprises a rod provided with an outer thread and a stop head provided with a hole with an inner thread coupled to the rod. The rod is connected such that it can pivot with respect to the axis of a stationary pin rotatably installed in a housing formed in the fixed support, the axis of said stationary pin being parallel to the mentioned pivot axis. A rotation of the stop head of the adjustable stop varies the distance between the stop head and the stationary pin.

In both cases, the rod of the adjustable stop is slidingly passed through a transverse hole formed in a mobile pin rotatably installed in a housing of the pivoting body. The axis of said mobile pin is likewise parallel to the pivot axis and to the axis of the stationary pin, and is located such that when the pivoting body pivots about the pivot axis the mobile pin moves closer to or away from the stationary pin. The stop head is connected to the corresponding rod of the adjustable stop on one side of the mobile pin opposite the stationary pin.

The mentioned transverse hole of the mobile pin has a bell mouth in which the stop head is housed when the pivoting body is in the service position. The mobile pin comprises an axial hole connected with said bell mouth, and the circumferential groove of the stop head is arranged aligned with said axial hole when the stop head is housed in said bell mouth.

The mentioned locking member comprises a retaining portion housed such that it can slide along said axial hole of the mobile pin between the inactive position, in which said retaining portion is removed from said circumferential groove of the adjustable stop, and the locking position, in which said retaining portion is inserted into the circumferential groove of the adjustable stop. The locking member comprises a shoulder on which a release spring acts to push the locking member towards the inactive position. The locking member further has a driving end opposite the retaining portion which projects from the axial hole of the mobile pin to a position close to an articulation pin about which the arm rotates with respect to the pivoting body.

BRIEF DESCRIPTION OF THE DRAWINGS

The previous and other features and advantages will be more fully understood from the following detailed description of an exemplary embodiment with reference to the attached drawings, in which.

DETAILED DESCRIPTION OF EXEMPLARY EMBODIMENTS

With reference first to FIGS. 1 to 7, they show a pivoting support assembly with a locking device for an awning arm according to an embodiment of the present invention, which comprises a fixed support 10 configured as a clamp to be rigidly fixed, for example by means of screw and nut groups 4*a*, 4*b*, to a tubular support 3 fixed to a wall or another structure.

Figure 1:
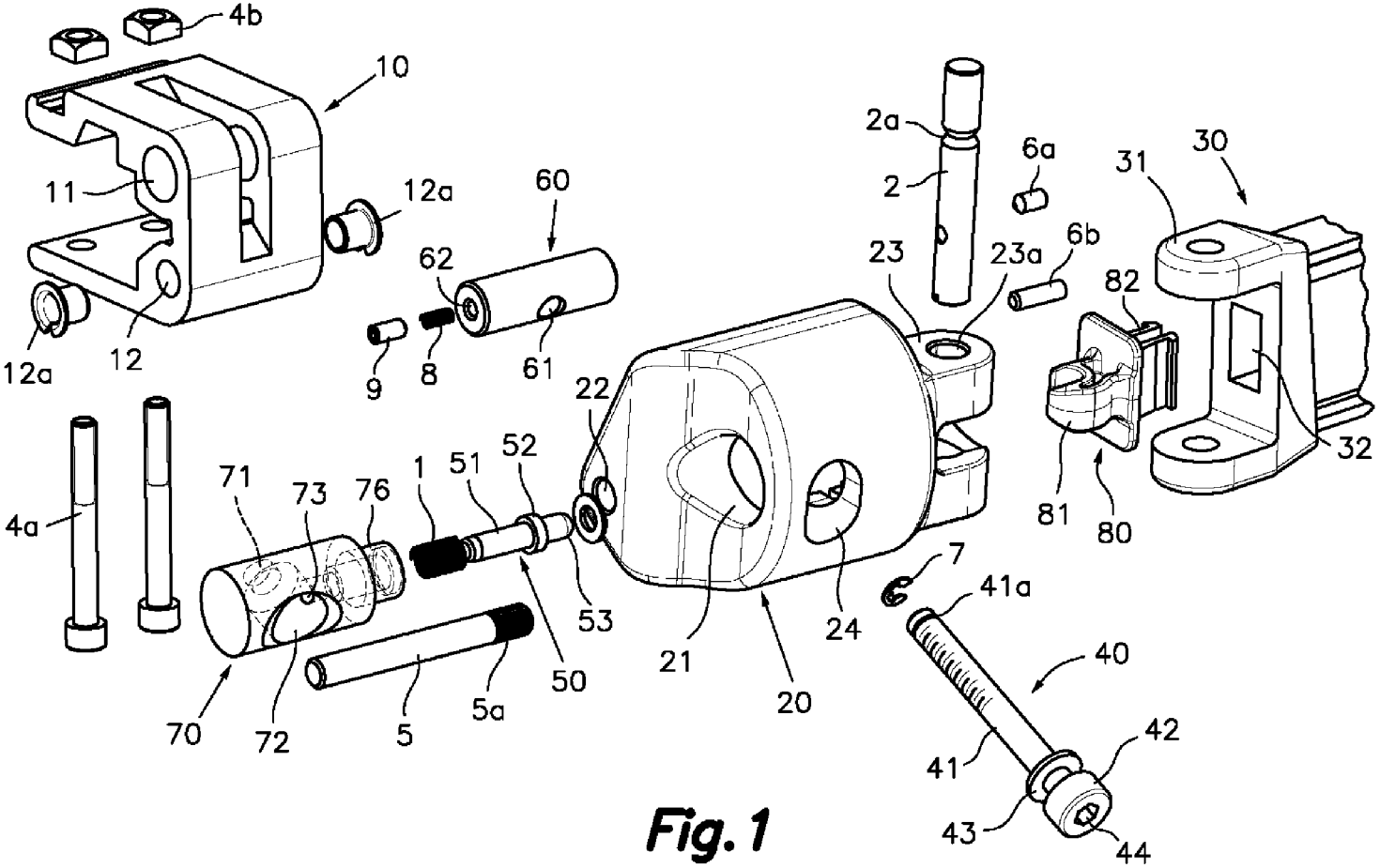
FIG. 1 is a perspective exploded view of a pivoting support assembly with a locking device for an awning arm according to an embodiment of the present invention.
Figure 2:
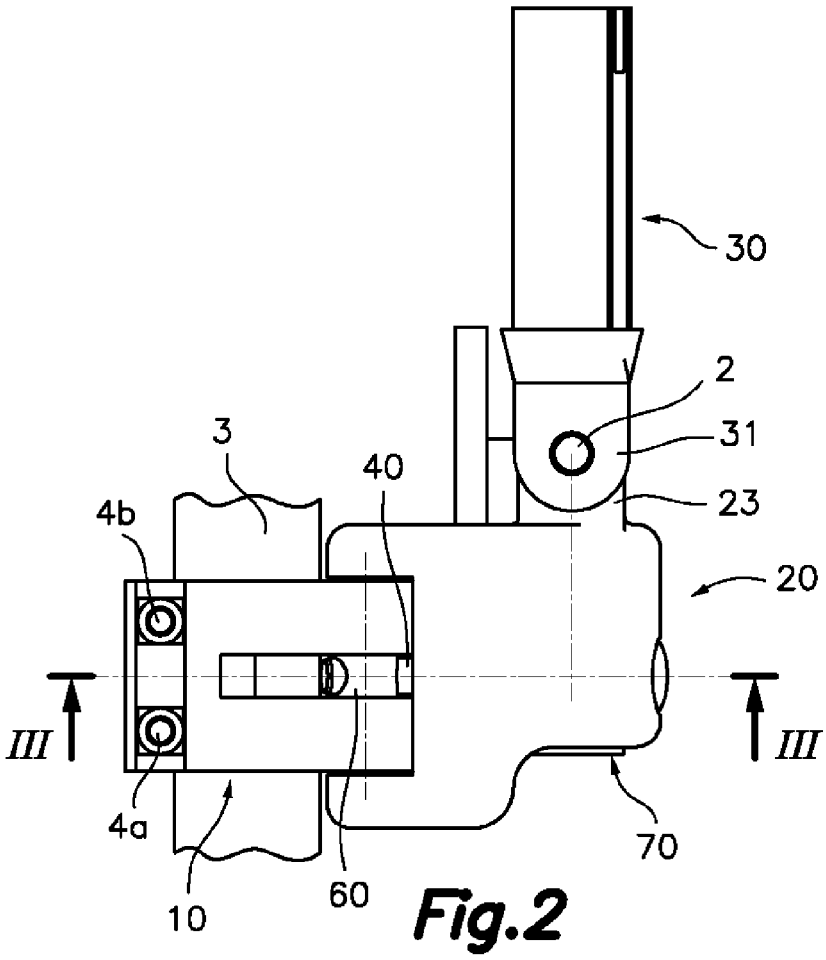
FIG. 2 is a plan view of the support assembly in a retracted position.
Figure 3:
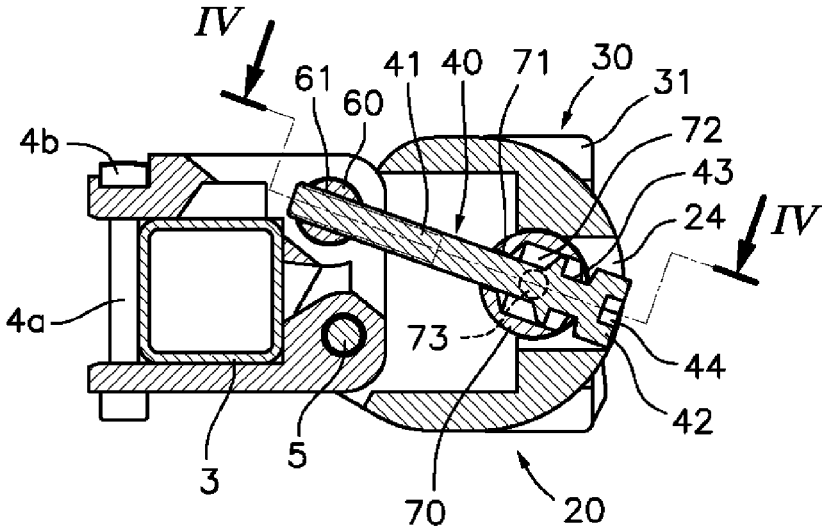
FIG. 3 is a cross-sectional view taken through the plane indicated by line III-III of FIG. 2.
Figure 4:
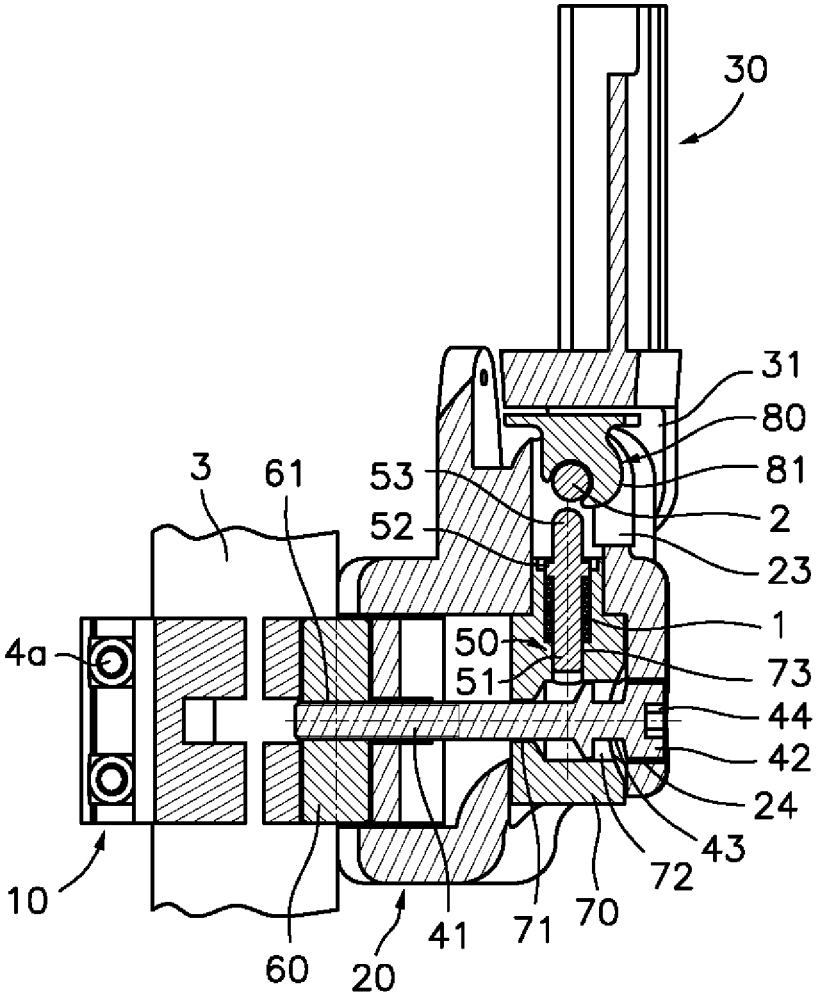
FIG. 4 is a cross-sectional view taken through the plane indicated by line IV-IV of FIG. 3.
Figure 5:
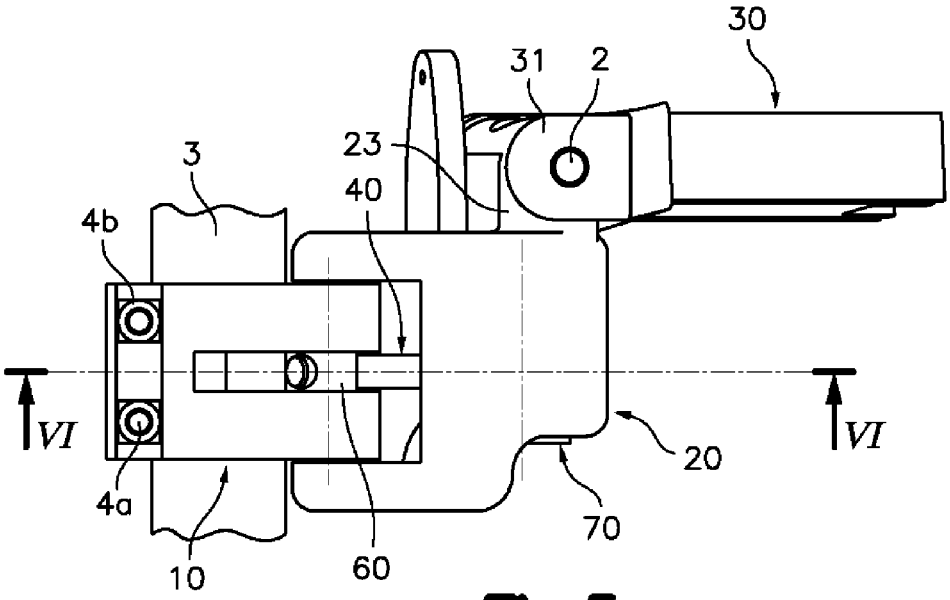
FIG. 5 is a plan view of the support assembly in a service position.
Figure 6:
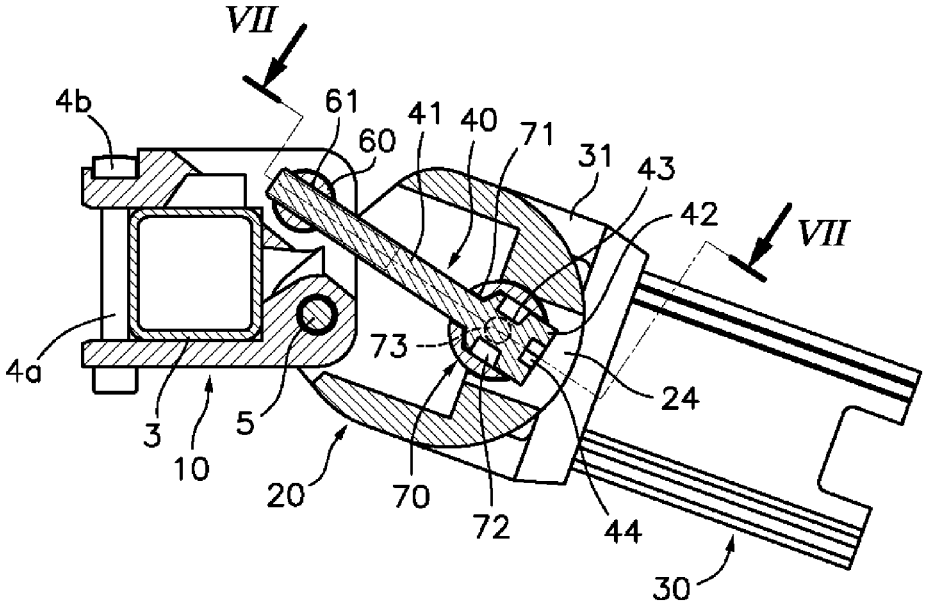
FIG. 6 is a cross-sectional view taken through the plane indicated by line VI-VI of FIG. 5.
Figure 7:
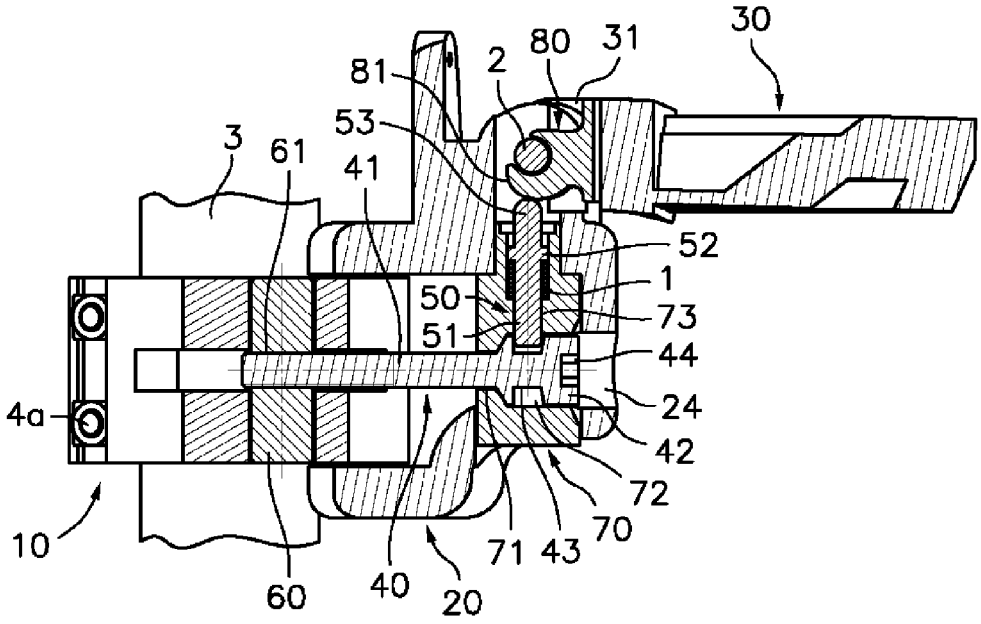
FIG. 7 is a cross-sectional view taken through the plane indicated by line VII-VII of FIG. 6.

A pivoting body 20 is articulately supported on said fixed support 10 such that it can perform a pivoting movement about an axis of a pivot 5 parallel to the axis of a winding roller (not shown) in which a canvas of the awning is wound and unwound. The pivot 5 is inserted into holes 12, 22 formed in the fixed support 10 and the pivoting body 20, respectively, in cooperation with friction bushings 12*a*. Thus, the pivoting body 20 can pivot between a retracted position (FIGS. 2, 3 and 4) and a service position (FIGS. 5, 6 and 7). The pivot 5 has at one end a knurling or striation 5*a* which is snap-fit into one of the holes 22 of the pivoting body 20 without needing other fixing means.

An arm 30 is in turn articulately supported on said pivoting body 20 such that it can rotate between a folded position (FIGS. 2, 3 and 4) and an extended position (FIGS. 5, 6 and 7) about the axis of an articulation pin 2. The figures only depict an articulation end of the arm 30 including fork branches 31 supporting the mentioned articulation pin 2 in cooperation with corresponding fork branches 23 projecting from the pivoting body 20.

The support assembly preferably comprises a device similar to the one described in patent EP-A-1767721, belonging to the current applicant, for adjusting the inclination of the articulation pin 2 with respect to the pivoting body 20 in cooperation with the configuration of the holes 23*a* of the fork branches 23, a perimetric groove 2*a* of the articulation pin 2 and a pair of adjustment screws 6*a*, 6*b*.

The support assembly includes an adjustable stop 40 for limiting the pivoting movement of the pivoting body 20 with respect to the fixed support 10, thus determining the degree of inclination of the awning in said service position (FIGS. 5, 6 and 7).

In the embodiment shown in FIGS. 1 to 7, the mentioned adjustable stop 40 has the form of a screw and comprises a rod 41 with an outer thread and a stop head 42 rigidly fixed to said rod 41. The head 42 of the adjustable stop 40 has a circumferential groove 43 and a grip element 44 located at an end thereof and configured to be gripped by a rotating driving tool, such as a screwdriver or an Allen key, for adjusting the position of the adjustable stop 40.

The fixed support 10 has formed therein a housing 11 in which a stationary pin 60 is rotatably housed, which stationary pin 60 has a transverse hole 61 with an inner thread. The axis of said stationary pin 60 is parallel to the axis of the pivot 5. The pivoting body 20 has formed therein a housing 21 in which a mobile pin 70 is rotatably installed, the axis of said mobile pin 70 being likewise parallel to the axis of the pivot 5. The mentioned mobile pin 70 comprises a transverse hole 71 provided with a bell mouth 72 on one side opposite the stationary pin 60, and an axial hole 73 communicating said bell mouth 72 with one end of the mobile pin 70 adjacent to said fork branches 23 (see also FIGS. 9 and 13).

The threaded rod 41 is slidingly passed through the transverse hole 71 of the mobile pin 70 and screwed in the threaded transverse hole 61 of the stationary pin 60, such that when the pivoting body is in its retracted position (FIGS. 2, 3 and 4), the length of the rod 41 maintains the stop head 42 of the adjustable stop 40 far from a contact surface at the bottom of the bell mouth 72 of the mobile pin 70. Preferably, a safety ring 7 fixed to a perimetric groove 41*a* at the end of the rod 41 prevents the rod 41 from coming out of the threaded transverse hole 61, and the stationary pin 60 has an axial hole 62 communicating with the threaded transverse hole 61, and in which there is housed a spring 8 pressed against the rod 41 by a screw 9 coupled to a thread of said axial hole 62 to prevent an involuntary rotation of the rod 41 due to vibrations, etc.

When the pivoting body adopts its service position (FIGS. 5, 6 and 7), the stop head 42 of the adjustable stop 40 is housed in the bell mouth 72 of the mobile pin 70 and is supported on said contact surface at the bottom of the bell mouth 72 of the mobile pin 70, thus limiting the pivoting movement of the pivoting body 20. When the stop head 42 is housed in the bell mouth 72, the circumferential groove 43 of the stop head 42 is aligned with the axial hole 73 of the mobile pin 70 and the mentioned grip element 44 of the stop head 42 is accessible through an opening 24 formed in the pivoting body 20.

The support assembly comprises locking means linked to the movement of the arm 30 for locking the pivoting body 20 in its service position when the arm 30 is in its extended position (FIGS. 5, 6 and 7). Said locking means comprise a locking member 50 having a retaining portion 51 housed in the axial hole 73 of the mobile pin 70 such that it can slide therealong between an inactive position, in which said retaining portion 51 is removed from the bell mouth 72 of the mobile pin 70, and a locking position, in which said retaining portion 51 projects towards the inside of the bell mouth 72.

The locking member 50 comprises a driving end 53 opposite the retaining portion 51 and projecting from the axial hole 73 of the mobile pin 70 between the two fork branches 23 to a position close to the articulation pin 2 of the arm 30. The locking member 50 further comprises a shoulder 52 on which there acts a release coil spring 1 arranged around the locking member 50 and housed under compression in a widened region of the axial hole 73 to push the locking member 50 towards the inactive position.

A cam 80 is fixed at one end of the arm 30, which cam 80 has elastic arms 82 which are inserted into an opening 32 of the arm 30. Said cam 80 comprises a cam surface 81 eccentrically arranged around the articulation pin 2 of the arm 30 between the fork branches 23 of the pivoting body 20 when the arm 30 is coupled to the pivoting body 20. The mentioned cam 80 is configured to press the driving end 53 of the locking member 50 and thus move the locking member 50 against the force of said release spring 1 towards its locking position when the arm 30 is moved from its folded position to its extended position.

When the arm 30 is in its folded position the locking member 50 is in said inactive position, such that the retaining portion 51 of the locking member 50 does not interfere with the adjustable stop 40 (FIG. 4) and the pivoting body 20 can pivot about the axis of the pivot 5 towards its service position. Given that the arm 30 performs the movement towards its extended position after the pivoting body 20 has reached its service position, in which the stop head 42 of the adjustable stop 40 is housed in the bell mouth 72 of the mobile pin 70, when the cam 80 attached to the arm 30 pushes the locking member 50 towards its locking position the retaining portion 51 of the locking member 50 is inserted into the circumferential groove 43 of the adjustable stop 40 (FIG. 7).

Thus, when the locking member 50 is in its locking position, with the retaining portion 51 inserted into the circumferential groove 43 of the adjustable stop 40, the retaining portion 51 of the locking member 50 prevents any movement of the adjustable stop 40 in the axial direction thereof with respect to the pivoting body 20, which prevents wind or other factors from undesirably moving the pivoting body towards its retracted position when the awning is unfolded.

However, the locking member 50 in its locking position does not prevent the rotation of the adjustable stop 40 since the retaining portion 51 can slide along the circumferential groove 43. Furthermore, given that when the locking member 50 is in its locking position the grip element 44 of the stop head 42 is not hindered by the locking member 50 and is accessible through the mentioned opening 24 of the pivoting body 20, the stop head 42 can be gripped by means of the driving tool to make the adjustable stop 40 rotate. Thus, the degree of inclination of the awning in the service position can be adjusted even when the adjustable stop 40 is locked by the locking member 50.

Figure 8:
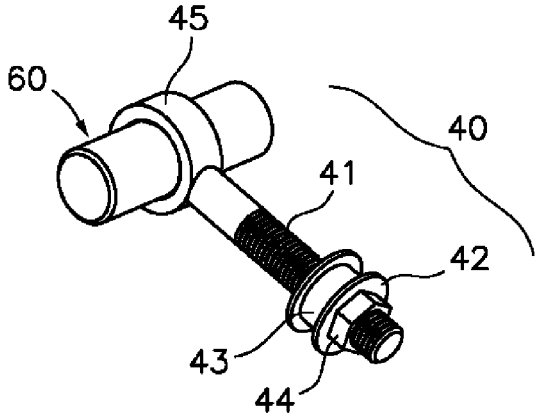
FIG. 8 is a perspective view of an adjustable stop according to an alternative embodiment of the present invention.

In relation now to FIG. 8, an alternative embodiment for the adjustable stop 40 is described. Here, the rod 41 and the stop head 42 of the adjustable stop 40 are separate parts. The rod 41 has formed at one end a ring 45 through which the stationary pin 60 is inserted, such that the rod 41 can pivot about said stationary pin 60 but cannot move axially with respect to the longitudinal axis of the rod 41. The stop head 42 has a hole with an inner thread coupled to an outer thread formed in the rod 41. The stop head 42 comprises, similarly to the embodiment described above in relation to FIGS. 1 to 7, a circumferential groove 43 and a grip element 44, which in this case can be a polygonal formation arranged around the threaded hole of the stop head 42 and suitable for being coupled by means of a box wrench or the like.

Thus, when the stop head 42 is rotated in relation to the rod 41, the distance between the stationary pin 60 and the stop head 42 varies. Here, the construction of the mobile pin 70, the locking member 50 and the cam 80 is substantially similar to that described above in relation to FIGS. 1 to 7, although the bell mouth 72 of the mobile pin 70 must be slightly wider.

Figure 9:
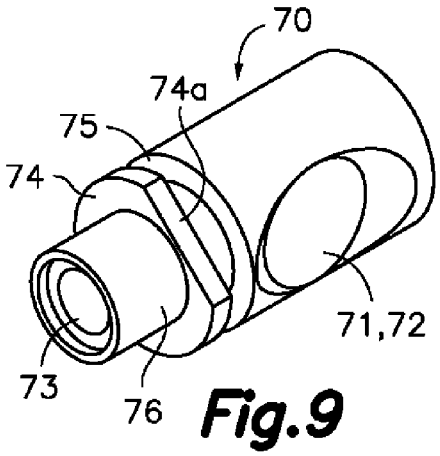
FIG. 9 is an enlarged perspective view of a mobile pin according to an embodiment of the present invention.

FIGS. 9 to 13 show a particular embodiment comprising retaining means for retaining the mobile pin 70 in the pivoting body 20 when both of them are assembled in a service position without needing to use additional parts. As is best shown in FIG. 9, the mobile pin 70 comprises a cylindrical body configured to be inserted and rotate inside the housing 21 of the pivoting body 20. From one end of the cylindrical body adjacent to the axial hole 73 there extends a cylindrical guide portion 76 with a smaller diameter configured to be inserted and rotate inside a hole 21*a* (FIGS. 10 and 13) which forms part of the housing 21 of the pivoting body 20. At this same end of the cylindrical body of the mobile pin 70 there is an annular flange 74 separated from the rest of the cylindrical body by a perimetric groove 75, and said annular flange 74 has a planar truncation 74*a*.

Figure 10:
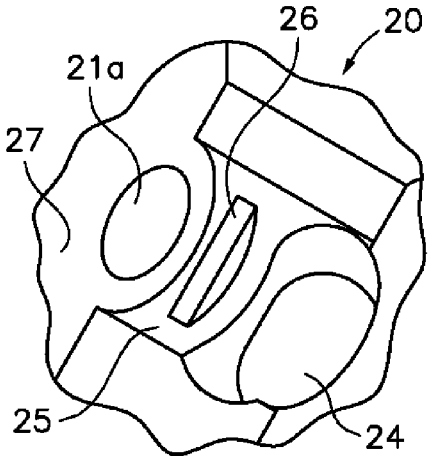
FIG. 10 is a partial perspective view of a pivoting body configured to receive and retain the mobile pin of FIG. 9.

The partial detail of FIG. 10 shows an inner cavity of the pivoting body 20, with the mentioned hole 21*a*, which is formed in an inner wall 27 on the side of the pivoting body 20 adjacent to the fork branches 23 (see also FIG. 13), and the opening 24, which is transverse to the axis of said hole 21*a*. The housing 21 comprises, in a region of said inner cavity of the pivoting body 20, a partly cylindrical inner surface 25 coaxial with the hole 21*a*, from which there projects a tab 26 perpendicular to the axis of the hole 21*a* and which has a planar upper surface.

Said planar truncation 74*a* of the annular flange 74 of the mobile pin 70 and said tab 26 of the pivoting body 20 are configured such that when the mobile pin 70 and the pivoting body 20 are in a relative angular assembly position (FIG. 11), in which the planar truncation 74*a* is parallel to said planar upper surface of the tab 26, the cylindrical guide portion 76 of the mobile pin 70 can be inserted into the hole 21*a* of the pivoting body to an axial assembly position in which the annular flange 74 of the mobile pin 70 abuts with said inner wall 27 of the pivoting body 20.

Figure 11:
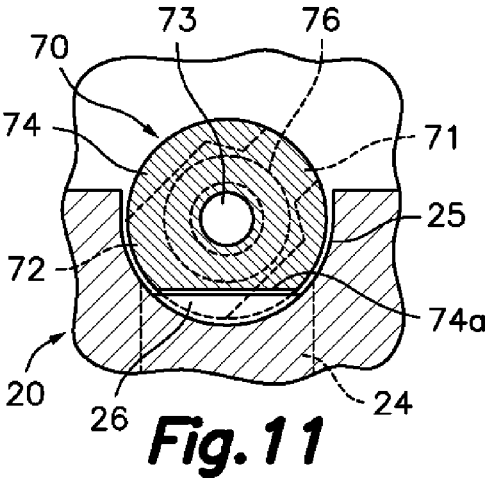
FIG. 11 is a cross-sectional view of the pivoting body and the mobile pin assembled in an assembly position.
Figure 12:
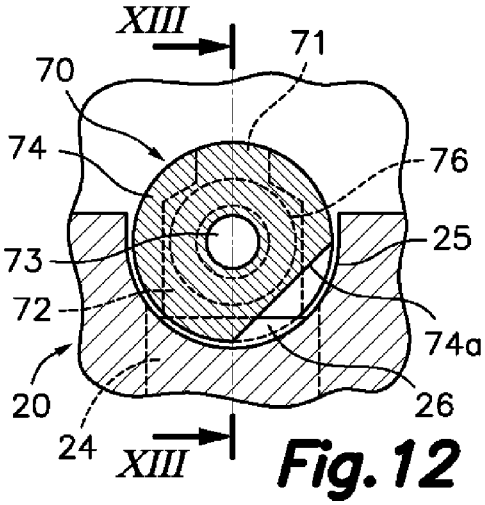
FIG. 12 is a cross-sectional view of the pivoting body and the mobile pin assembled in a retention position.

As shown in FIG. 11, in said relative angular assembly position the transverse hole 71 with the corresponding bell mouth 72 of the mobile pin 70 does not face the transverse opening 24 of the pivoting body 20 while the tab 76 is aligned with the perimetric groove 75. When from this axial and angular assembly position the mobile pin 70 is rotated to an angular service position (FIGS. 12 and 13), in which the transverse hole 71 and its corresponding bell mouth 72 of the mobile pin 70 face the transverse opening 24 of the pivoting body 20, the tab 26 of the pivoting body 20 is introduced into the perimetric groove 75 of the mobile pin 70 and thus prevents movements of the mobile pin 70 in an axial direction with respect to the pivoting body 20.

Figure 13:
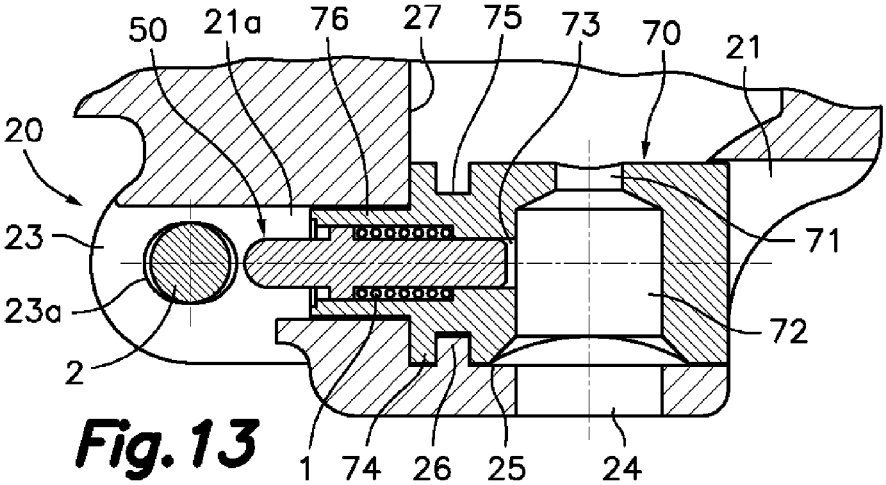
FIG. 13 is a longitudinal sectioned view of the pivoting body, the mobile pin and other elements assembled in said retention position.

FIG. 13 further shows the locking member 50 and the release spring 1 housed in the axial hole 73 of the mobile pin 70 and the articulation pin 2 inserted into the holes 23*a* of the fork branches 23 of the pivoting body 20. In the angular service position, the adjustable stop 40 can be operatively installed through the transverse opening 24 of the pivoting body 20 and through the transverse hole 71 and corresponding bell mouth 72 of the mobile pin 70.

Modifications and variations based on the embodiments shown and described will readily occur to one skilled in the art without departing from the scope of the present invention as it is defined in the attached claims.

What is claimed is:

1. A pivoting support assembly with a locking device for an awning arm, of the type comprising: a fixed support (10); a pivoting body (20) articulately supported on said fixed support (10) such that it can perform a pivoting movement about a pivot axis parallel to that of a winding roller of a canvas of the awning between a retracted position and a service position; an arm (30) articulately supported on said pivoting body (20) such that it can rotate between a folded position and an extended position; an adjustable stop (40) for limiting said pivoting movement of the pivoting body (20), thus determining the degree of inclination of the awning in said service position; and locking means linked to the movement of the arm (30) for locking the pivoting body (20) in its service position when the arm is in its extended position, said locking means comprising a locking member (50) movable between an inactive position, in which said locking member (50) does not interfere with said adjustable stop (40), and a locking position, in which the locking member (50) locks the adjustable stop (40) with respect to the pivoting body (20) when the latter is in its service position, the adjustable stop (40) has a circumferential groove (43) and a grip element (44) configured to be gripped by a rotating driving tool to adjust the position thereof, and thus said degree of inclination of the awning; said locking member (50), when it is in its locking position, is inserted into said circumferential groove (43) of the adjustable stop (40) such that said grip element (44) is accessible and the adjustable stop (40) can be rotated but cannot be axially moved with respect to the pivoting body (20); said adjustable stop (40) comprises a rod (41) connected to the fixed support (10) such that it can pivot about a stationary pin (60) parallel to said pivot axis and slidingly passed through a transverse hole (71) formed in a mobile pin (70) rotatably installed in a housing (21) of the pivoting body (20), and a stop head (42) connected to said rod on one side of said mobile pin (70) opposite said stationary pin (60); said stop head (42) is housed in a bell mouth (72) of said hole (71) formed in said mobile pin (70) when the pivoting body (20) is in the service position; and the circumferential groove (43) of the stop head (42) is aligned with an axial hole (73) formed in said mobile pin (70) when the stop head (42) is housed in said bell mouth (72), characterized in that said locking member (50) comprises a retaining portion (51) housed such that it can slide along said axial hole (73) of the mobile pin (70) between the inactive position, in which said retaining portion (51) is removed from the circumferential groove (43) of the adjustable stop (40), and the locking position, in which said retaining portion (51) is inserted into the circumferential groove (43) of the adjustable stop (40).

2. The pivoting support assembly according to claim 1, wherein said locking means further comprise a release spring (1) arranged to push the locking member (50) towards the inactive position, and a cam (80) fixed to the arm (30) and configured to move the locking member (50) against the force of said release spring (1) towards its locking position when the arm (30) is moved to its extended position.

3. The pivoting support assembly according to claim 2, wherein the locking member (50) comprises a driving end (53) projecting from the axial hole (73) of the mobile pin (70) to a position in which it interacts with said cam (80).

4. The pivoting support assembly according to claim 3, wherein the cam (80) comprises a cam surface (81) eccentrically arranged around an articulation pin (2) of the arm (30) with respect to the pivoting body (20).

5. The pivoting support assembly according to claim 1, wherein the locking member (50) comprises a shoulder (52) on which said release spring (1) acts to push the locking member (50) towards the inactive position.

6. The pivoting support assembly according to claim 1, wherein said rod (41) has an outer thread coupled to a threaded transverse hole (61) formed in said stationary pin (60), which is rotatably installed in a housing (11) of the fixed support (10).

7. The pivoting support assembly according to claim 6, wherein the stop head (42) is rigidly attached to said rod (41).

8. The pivoting support assembly according to claim 1, wherein said rod (41) can pivot about said stationary pin (60) but cannot move axially with respect to it.

9. The pivoting support assembly according to claim 8, wherein the stop head (42) has a hole with an inner thread coupled to an outer thread formed in the rod (41).

10. The pivoting support assembly according to claim 1, further comprising retaining means for retaining the mobile pin (70) with respect to the pivoting body (20) when the mobile in (70) and the pivoting body (20) are assembled in a service position in which the mobile pin (70) can rotate a certain angle and without needing to use additional parts.

11. The pivoting support assembly according to claim 10, wherein said retaining means comprise a tab (26) projecting from an inner surface (25) of the housing (21) of the pivoting body (20) and an annular flange (74) adjacent to a perimetric groove (75) of the mobile pin (70), wherein a planar truncation (74a) of said annular flange (74) allows inserting the mobile pin (70) into the housing (21) of the pivoting body (20) to an axial assembly position when the mobile pin (70) and the pivoting body (20) are in a relative angular assembly position, and wherein said tab (26) of the pivoting body (20) is introduced into said perimetric groove (75) of the mobile pin (70) when the mobile pin is rotated from said axial and angular assembly position to an angular service position in which the adjustable stop (40) can be installed through an opening (24) formed in the pivoting body (20) and through said transverse hole (71) of the mobile pin (70).

* * * * *